US006922174B2

(12) United States Patent
Haunberger et al.

(10) Patent No.: US 6,922,174 B2
(45) Date of Patent: Jul. 26, 2005

(54) MOBILE RADIO ANTENNA FOR A BASE STATION

(75) Inventors: Thomas Haunberger, Bad Reichenhall (DE); Manfred Stolle, Bad Aibling (DE)

(73) Assignee: Kathrein-Werke KG, Rosenheim (DE)

( * ) Notice: Subject to any disclaimer, the term of this patent is extended or adjusted under 35 U.S.C. 154(b) by 18 days.

(21) Appl. No.: 10/606,285

(22) Filed: Jun. 26, 2003

(65) Prior Publication Data

US 2004/0263389 A1 Dec. 30, 2004

(51) Int. Cl.[7] ..... H01Q 1/24; H01Q 1/00
(52) U.S. Cl. ..... 343/702; 343/907
(58) Field of Search ..... 343/702, 767, 343/795, 870, 872, 873, 874, 907, 904, 906

(56) References Cited

U.S. PATENT DOCUMENTS

| | | | | | |
|---|---|---|---|---|---|
| 5,156,559 | A | | 10/1992 | Sommer et al. | 439/582 |
| 5,903,822 | A | * | 5/1999 | Sekine et al. | 455/575.7 |
| 6,155,112 | A | * | 12/2000 | Eckert et al. | 73/290 V |
| 6,276,199 | B1 | * | 8/2001 | Eckert et al. | 73/290 V |
| 6,295,031 | B1 | * | 9/2001 | Wallace et al. | 343/702 |
| 6,388,622 | B1 | | 5/2002 | Jennetti et al. | 343/700 |
| 6,414,636 | B1 | | 7/2002 | Godard et al. | 343/700 |
| 6,646,606 | B2 | * | 11/2003 | Mikkola et al. | 343/700 MS |

FOREIGN PATENT DOCUMENTS

| | | | |
|---|---|---|---|
| DE | 15 91 559 | A | 10/1970 |
| DE | 25 13 498 | A1 | 10/1975 |
| DE | 26 09 076 | A | 9/1977 |
| DE | 195 44 324 | A1 | 6/1997 |
| EP | 0 391 257 | | 10/1990 |
| EP | 0 489 252 | A1 | 6/1992 |
| EP | 0 814 538 | A | 12/1997 |
| EP | 0 973 231 | A2 | 1/2000 |
| GB | 826975 | | 1/1960 |
| GB | 2 187 599 | A | 9/1987 |
| JP | 61 072401 | A | 4/1986 |
| JP | 2002 353702 | | 12/2002 |
| WO | WO 97/08776 | A | 3/1997 |

OTHER PUBLICATIONS

Khattab, Tawfik et al., "Principles of Low PIM Hardware Design," PROCEEDINGS OF THE THIRTEENTH NATIONAL RADIO SCIENCE CONFERENCE, Cairo, Egypt (Mar. 19–21, 1996).

* cited by examiner

*Primary Examiner*—Don Wong
*Assistant Examiner*—Minh Dieu A
(74) *Attorney, Agent, or Firm*—Nixon & Vanderhye P.C.

(57) ABSTRACT

An improved antenna is distinguished by the following features:

the electrical connection between the component (319) and the antenna elements (315) is made via an interface (321), such that at least the inner conductor sections **(7*a*, 9*a*) and/or the outer conductor sections (7*b*, 9*b*) are coupled or can be coupled capacitively, an antenna-side connecting section (7) and a connecting section (9), which interacts with it and is part of the component (319) which can be connected, are provided, and the components (319) which can be connected to the antenna for RF purposes can be connected by pushing in or pushing out the at least one associated connecting section (9) into or out of the correspondingly designed antenna-side connecting section (7)**.

26 Claims, 4 Drawing Sheets

Fig. 4
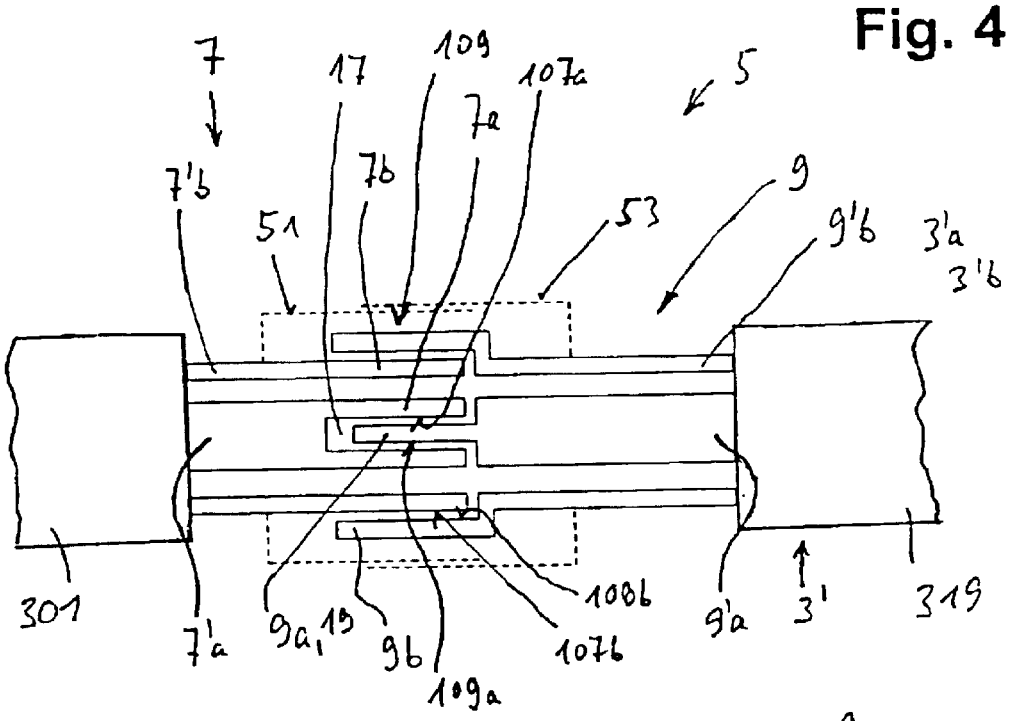
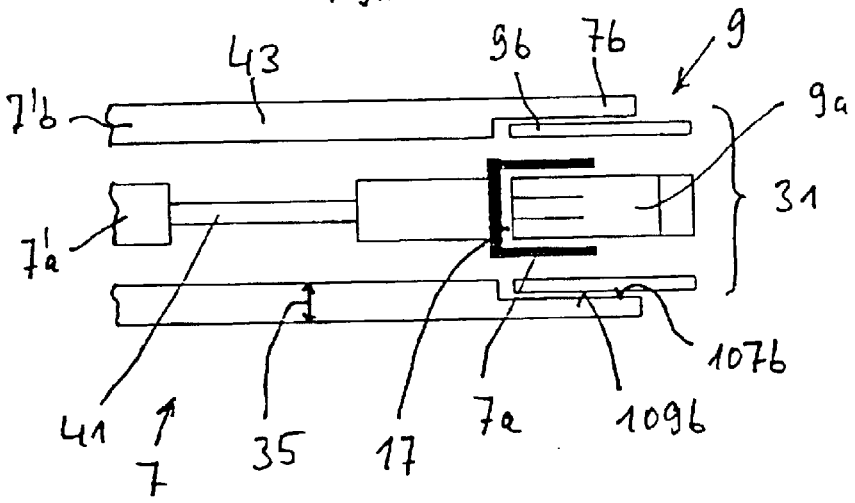
Fig. 5

MOBILE RADIO ANTENNA FOR A BASE STATION

FIELD OF THE INVENTION

The invention relates to a mobile radio antenna for a base station, according to the precharacterizing clause of claim 1.

The communication between mobile subscribers in a cell which is associated with a mobile radio antenna can be handled via stationary mobile radio antennas.

BACKGROUND OF THE INVENTION

The mobile radio antenna is in this case normally mounted on a mast, on the roof of a building, or in general on a building, etc. in order to illuminate an appropriate area. The actual base station in which the electrical components, including amplifiers, filter systems, etc. are accommodated is provided near to the ground or near to the building, generally at the foot of the antenna mast. The electrical connection for feeding and for receiving the signals which are respectively transmitted and received via the mobile radio antenna is then produced via cables which originate from the base station and lead to the antenna.

SUMMARY

The object of the present invention, against the background of this prior art, is to provide an improved antenna system, in particular for the mobile radio field.

According to the invention, the object is achieved by the features as specified in claim 1. Advantageous refinements of the invention are specified in the dependent claims.

In contrast to the previous solution, an amplifier close to the antenna, a combiner, a filter module close to the antenna, etc. can now be accommodated directly in or on the antenna housing, so that the separate cables according to the prior art between the electronic or electrical components of the base station on the one hand and the antenna input on the other hand are no longer required. Thus, in principle, there is also no longer any need to accommodate the amplifier in a separate housing, which is separated from the antenna housing, or to connect it to the antenna input via high-cost cables. In particular for IMA reasons as well, very high-cost cable connections were required for this purpose in the prior art, which, on the one hand, were costly while, on the other hand, their installation was likewise time-consuming and occupied a large amount of space.

According to the invention, an interface is now provided in the antenna housing in order, for example, to directly accommodate and to connect an amplifier, a combiner, filter modules and/or other electrical and electronic components. To this extent, the following text refers in particular to electrical components which can be connected. These electrical components or the at least one electrical component can preferably be inserted like a module into the antenna housing.

Now, according to the invention, no coaxial or other conductive plug connection is preferably provided directly, but an RF connector without any contact, via which the electrical connection can be made between the connected electrical component and the actual antenna components.

A connection is particularly preferable which is purely without any contact and at the same time is coaxial. In this case, provision is made for both the outer and inner conductors to be coupled to one another in the area of the connector, coaxially and without any contact. However, it is also possible for either only the outer conductor or only the inner conductor to be coupled without any contact, and for the respective other conductor, that is to say the inner conductor or the outer conductor, then to be conductively coupled. Coaxial connectors are preferred, since they can also be coupled to one another in a relative rotation position.

The present invention now means that no additional cables (jumpers) are required. The at least one electrical component which can be connected is accommodated in the weatherproof antenna housing. For example, it can be installed via a removable antenna cover, which faces downward. In the assembled state, the arrangement appears like a normal antenna. From the outside, it is impossible to see that, for example, an amplifier and/or some other electrical component or assembly is connected.

For the purposes of the present invention, an RF connector without any contact is proposed according to one preferred embodiment, whose RF components can be connected to one another considerably more easily and at a considerably lower cost than in the case of the prior art. A connection without any contact makes it possible to avoid problems such as those which occur with a conventional connection, for example in the case of end or spring contacts. This is because, in particular, poor conductive contacts cause intermodulation problems which can lead to failure, of reception channels, particularly in the case of mobile radio. The connection without any contact results in the mechanical and electrical functions being separated. A screw connection or lock therefore does not need to carry out any electrical functions. Furthermore, the connector without any contact can also be matched to existing standard connectors (for example 7–16 connectors). Connectors without any contact also have considerable advantages for RF measurement and testing, because, for example, they can be used as IMA-free (intermodulation-free), quick-release connectors.

In one particularly preferred embodiment, the RF connector without any contact is constructed on the one hand without any contact and on the other hand coaxially, so that the advantages mentioned above occur and are provided cumulatively.

In one particularly preferred embodiment of the invention, the coaxial electrical length for the inner conductor and/or outer conductor coupling without any contact may have a length of $\lambda/4$ (lambda in this case preferably corresponds to the mean wavelength at the mid-frequency of the frequency band to be transmitted), to be precise with respect to the frequency to be transmitted, preferably the mid-frequency of a frequency band to be transmitted. In other words, the inner and/or outer conductor coupling is in the form of a $\lambda/4$ pot. In contrast to this, in a further development of the invention that is likewise envisaged, the matching structure can also be provided avoiding the use of a $\lambda/4$ axial physical length for the inner conductor and/or outer conductor coupling, specifically in particular when a corresponding matching structure is additionally provided. This measure may have advantages, particularly in the case of a small coupling surface and/or short coupling length.

The antenna according to the invention with the proposed connecting technique without any contacts can thus be constructed such that the respective connecting sections to be coupled are each firmly connected to associated RF components, which can be joined together directly via the connector. In other words, the electrical component which can be inserted has at least one firmly connected connecting section without any contact, which can be coupled to a corresponding connecting section on the antenna side without any contact. Thus, at least one interface is thus preferably provided which has no contact, is in this case coaxial and whose one connection half is part of the electrical physical component which is intended to be connected to the antenna, with the other connection half then being part of the antenna or of the antenna arrangement. The connection half, which preferably has no contact and is coaxial, of the component which is to be connected and is equipped with the corresponding interface therefore just has to be pushed into the corresponding coaxial connection half without any contact on the antenna side, in order to make the electrical connection. Only the mechanical fixing for the connected electrical physical component now need be carried out in this position in order to ensure that it is held securely.

Finally, it is also possible within the scope of the invention to combine preferably two or more such connectors or plug connectors to form a corresponding multiconnection plug, via which at least two separate cables can be connected, preferably without any contact, to the corresponding cables on the antenna side.

The connection without any contact results in major advantages in terms of assembly. Problems such as those which occur and can occur in the case of the conventional conductive contacts relating to spring and end contacts are avoided by using the coupling without any contact according to the present invention. The plug connection of a multiple connector can thus be made using one installation unit. There is no need to plug all the connectors together individually.

As already mentioned, it is possible within the scope of the invention to provide a coupling and/or a connection without any contact by means of standard connectors as well, for example 7–16 or N female connectors. The invention is in this case also particularly suitable for the transmission of high RF power levels, with the coupling without any contact also making it possible to provide the desired DC decoupling, which has advantages in particular when an electrical connection is intended to be provided for an amplifier, an instrument, etc.

Finally, a wide frequency bandwidth can also be provided within the scope of the invention.

Finally, the connector which has been explained can also be sealed axially by a simple O-ring (for example composed of silicone) in its outer conductor coupling point (for example in the pot). It would thus be possible to fit the electrical physical component, for example directly to the lower face of the antenna via an interface formed there, so that it would not be possible to install the connected physical component underneath a common antenna housing, but immediately adjacent to it in a separate housing.

In principle, it would also be feasible to speak not only of an RF connector without any contact or of an RF connection without any contact, but of a "capacitive RF connector". An expression such as this would, however, be correct only to a restricted extent. A capacitive coupling between cables is feasible only when the cable length is considerably less than $L \ll \lambda/4$. However, the present invention preferably makes use of a length which is greater than this. The cable coupling without any contact is thus best regarded in the sense of a capacitive and an inductive cable coupling. For this reason, the following text refers essentially to an "RF connector without any contact".

The invention will be explained in more detail in the following text with reference to drawings, in which, in detail:

DETAILED DESCRIPTION OF THE DRAWINGS

FIG. 4 shows a schematic axial section illustration through a coaxial connector without any contacts, as is used for the connection technique as shown in FIGS. 1 to 3;

FIG. 5 shows a modified exemplary embodiment from that shown in FIG. 4;

Figure 1:
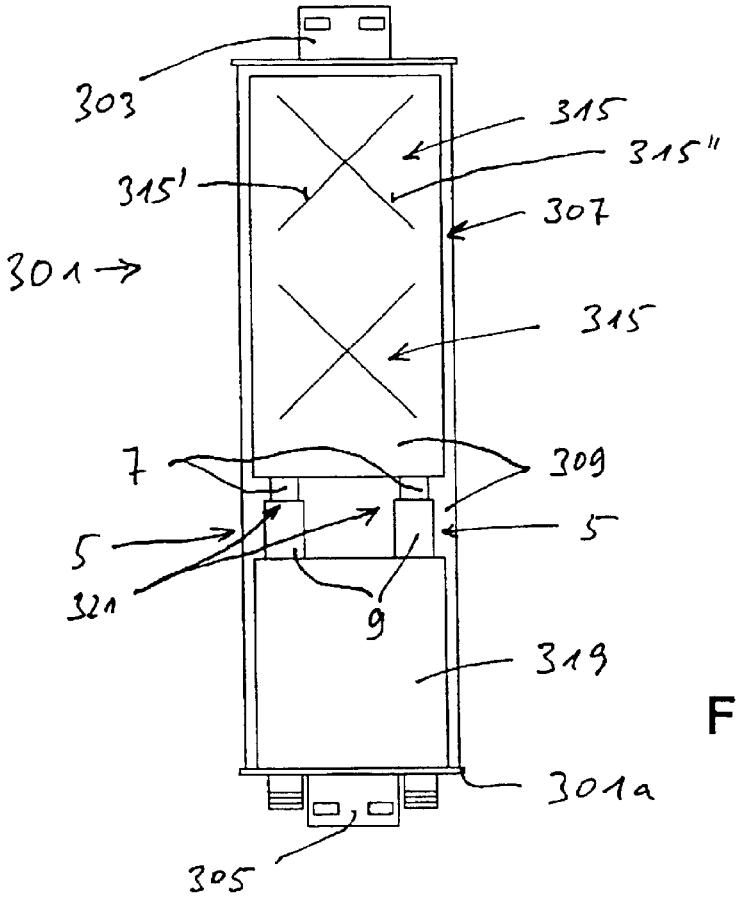
FIG. 1 shows a schematic plan view of an antenna arrangement according to the invention with a common antenna housing (radome), to whose lower face an electrical physical component is connected via two RF connectors without any contacts.

FIG. 1 shows a schematic side view of an antenna 301 which can be attached for example to an antenna mast which is not shown in FIG. 1—via an attachment 303 at the top and an attachment 305 at the bottom.

The antenna has a housing 307 with a base plate or mounting plate 309, on which, as is illustrated in FIG. 1 (in which the antenna is shown in the form of a schematic cross section), a housing cover 311, namely what is referred to as a radome, can be placed, in order to protect the corresponding components under the radome against weather influences.

Merely for schematic illustrative purposes, the illustrated exemplary embodiment shows an antenna which has two cruciform dipoles 315, which are arranged offset vertically one above the other. The associated dipoles 315' and 315" are in this case aligned at angles of +45° and −45°, respectively, to the horizontal (or to the vertical), as has been known for a long time.

In the illustrated exemplary embodiment, an electrical component 319 is now connected and may, for example, be an amplifier (for example what is referred to as a TMA amplifier), that is to say, for example, a "top mounted amplifier".

For this purpose, the illustrated exemplary embodiment has two connectors 5 which, for example, each have an antenna-side connecting section 7 and a second connecting section 9 which can in each case be connected to the interface 321 formed in this way and which, in the illustrated exemplary embodiment, is part of the electrical component 319 that can be connected and is preferably firmly connected to it, that is to say not via flexible coaxial cables connecting the connecting section to the component 319 which can be connected.

The following text describes the rest of the construction of the coaxial connector as shown in FIGS. 4 et. seqq.

FIG. 4 shows, schematically, the end area of the antenna 301 which is generally at the bottom in the area of use, on which one coaxial connecting section 7 is provided. On the right, FIG. 4 also shows a part of the housing cover of the electrical component 319 which can be connected, and on which the coaxial connecting section 109 without any contact is provided.

One connector 7 is in this case used, for example, for feeding and for reception of the dipoles which are aligned, for example, at an angle −45° to the horizontal while, in contrast, an electrical connection for feeding and for reception of the dipoles which are aligned at an angle of +45° is made via the second connector, so that it is possible to receive and to transmit in one polarization plane via the one connector 5, and to receive or transmit via the second connector 5 in the second polarization plane, which is at right angles to the first.

The connecting section 7 which is located on the left in FIG. 4 is in this case electrically connected to an antenna-side RF coaxial cable.

In a corresponding way, the connecting section 9 which is located on the right in FIG. 4 is connected to an associated RF coaxial cable of the connected component 319.

As can be seen from the illustrated exemplary embodiment, one inner conductor section 7*a* is in the form of a socket and for this purpose has an axial inner conductor recess 17, which is formed from the associated end face of the inner conductor section 7*a* in the manner of an axially running blind hole.

In a corresponding way, the inner conductor section 9*a*, which interacts with it, of the second connecting section 9 is formed in the manner of an inner conductor pin 19, which engages in the inner conductor recess 17, without touching it, in the functional position.

The exemplary embodiment which is illustrated schematically in FIG. 4 also shows that the inner conductor sections 7*a* and 9*a* are designed to have the same diameter or at least approximately the same diameter adjacent to the inner conductor recess 17 or the inner conductor pin 19, respectively, in the axial direction.

The schematic illustration in FIG. 4 shows that the outer conductor section 7*b* is in the form of a sleeve and has a diameter which corresponds intrinsically to that of the outer conductor section 9'*b* of the second connecting section 9. In the area of the coupling section, however, the second outer conductor section 9*b* is provided with a pot 109, so that the outer conductor section 9*b* ends in the form of a sleeve over this pot 109, with the internal diameter of the pot 109 being at least slightly greater than the external diameter of the outer conductor section 7*b*, which ends in the pot in the functional position, of the first connecting section 7.

Since neither the inner conductor sections nor the outer conductor sections touch either on their inner or outer envelope surfaces nor at their end-face terminating ends, this results in an inner and outer conductor coupling without any contact.

The coupling without any contact is provided by the inner conductor coupling surfaces 107*a* and 109*a*, which are each in the form of concentric sleeves, and the outer conductor coupling surfaces 107*b* and 109*b*. However, the size of the inner and outer conductor coupling surfaces, that is to say in particular the length of the inner and outer conductor coupling surfaces, may have mechanically different lengths owing to the mechanical dimensions. The coupling without any contact of the inner conductor sections 7*a* and 9*a* and of the outer conductor sections 7*b* and 9*b*, that is to say in particular in the area of the pot 109 on the outer conductor section 9*b*, is preferably produced by means of an electrical length of $\lambda/4$ with respect to the frequency to be transmitted or the frequency band to be transmitted. The variable $\lambda$ preferably corresponds approximately to the wavelength $\lambda$ of the mid-frequency of the frequency band to be transmitted.

The length of the pots can thus be adjusted such that the open end of the electrical cable in each case acts as an open circuit, and internally as a short circuit. The coupling points thus act like a direct connection in the RF band, so that there is a smooth transition between the inner conductor and outer conductor. There is thus no need for any matching structure for impedance matching. However, the pots may also be matched by using a different axial length. In particular, if the coupling surface area is small and the axial coupling length is short, it may therefore be necessary to provide an additional matching structure in the connector, as well.

Nonconductive mechanical locking means 51 and 53 may also be connected to or interact with both connecting sections 7 and 9, and these are attached to one another, for example via a screw contact. A first and a second mechanical connecting section 51 and 53 can-thus be mechanically connected to one another, in order to use them to position the electrical parts of the connecting sections 7 and 9 in the predetermined position, in which they do not touch one another, with respect to one another.

As mentioned, the use of the nonconductive mechanically interacting locking means 51 and 53 makes it possible to hold the two coaxial connecting sections 7 and 9 with respect to one another such that they do not touch. Air is therefore generally used as the dielectric between the two connecting sections 7 and 9. The coaxial configuration allows the two connecting sections 7 and 9 to be rotated relative to one another, without this worsening or adversely affecting the coupling effect. Even if the two connecting sections 7 and 9 are not plugged together to the same insertion depth, disadvantageous effects can be precluded within wide limits.

In contrast to the described exemplary embodiment, it should be noted that the two RF components 1 and 1' which can be coupled via the connector 5 can in each case be firmly and directly connected to the respectively associated connecting section 7 or 9, so that the respective RF component 1 together with the connecting section 7, and the RF component 1' together with the connecting section 9, form a fixed unit. In other words, there is no need to use coaxial (generally flexible) cables 3 and 3' as illustrated in FIG. 1.

FIG. 5 provides a schematic illustration of a coupling, without any contact, to a standard female connector 31 which, in the illustrated exemplary embodiment, has a schematically illustrated inner conductor section 9*a* and an outer conductor section 9*b*. The inner conductor section 9*a* may in this case in principle be in the form of a male and female connector, into which a coaxial plug, with appropriate inner conductors in the form of plugs, can normally be inserted in order to make an electrically conductive connection.

This conventional standard female connector 31 allows a plug connection without any contact to be produced using a connecting section 7 corresponding to the exemplary embodiment shown in FIG. 5. This connecting section 7 now has a corresponding inner conductor section 7*a* with a pot-like inner conductor recess 17. The inner conductor recess 17 has a larger radial dimension, which is of such a size that the inner conductor section 9*a* can be inserted into it without touching it.

The outer conductor section 7*b* in the illustrated exemplary embodiment has a holding section 7' which widens in the form of a step, that is to say radially outward in the form of a step, in whose region the outer conductor section 9*b* of the standard female connector 31 ends. In other words, this is preferably configured such that the radial dimension between the inner envelope surface of the outer conductor 9*b* of the standard female connector 31 and the outer envelope surface of the outer conductor section 7*b* in the area of the outer conductor coupling surfaces 107*b*, 109*b* is equal to the radial wall thickness 35 of the outer conductor section 7'*b* of the connecting section 7 offset with respect to the coupling area.

Since, in this situation, it must be assumed that the coupling surfaces without any contact of the inner and outer conductors do not have an electrical length of λ/4 (where λ corresponds to the wavelength lambda) of the frequency band to be transmitted or of the frequency range to be transmitted, in particular that they do not have an electrical length of λ/4 of the mid-frequency of a frequency band to be transmitted, but that the coupling surfaces by virtue of their structure are smaller than those in the exemplary embodiment shown in FIG. 1, impedance matching 41, 43 is also provided in this exemplary embodiment. This impedance matching may be formed on the corresponding inner conductor section 7*a* and/or on the associated outer conductor section 7*b* of the connecting section 7. In the illustrated exemplary embodiment, the inner conductor 7'*a* is for this purpose formed over a specific axial length with a different diameter to that of the inner conductor sections 7*a* which are adjacent to it, axially in front of it or behind it. The impedance matching for the respective frequency band is therefore provided by means of a desired impedance transformation.

With reference to FIG. 5, it should also be noted that both the outer conductor 7*b* and the inner conductor 7*a* may have a smaller radial dimension. Specifically, if the inner conductor section 9*a* of the standard female connector 31 is hollow, the external dimension of the inner conductor section 7*a* may have a smaller size, so that this inner conductor 7*a* can be inserted into the hollow inner conductor section 9*a* of the second connecting part 9. Reversal is also possible for the outer conductor, in such a way that the external or diameter dimension of the outer conductor 7*b* of the connecting section 7 is of a smaller size than the unobstructed internal distance between the outer conductor 9*b* of the connecting section 9 and the female connector 31.

The overall structure of the connecting sections 7 and 9, which can be plugged into one another, or of a connecting section 7 and of a further connecting section in the form of a standard female connector 31 may be produced by means of electrically nonconductive fixing or locking means 51, 53, such that the inner conductor and outer conductor can be coupled without any contact, without using any electrically nonconductive insulating materials located between them. Thus, in other words, only air, for example, is used between the coupling surfaces. However, irrespective of this, otherwise normal insulating materials, in particular in the form of a dielectric, may also be used in these areas.

Figure 2:
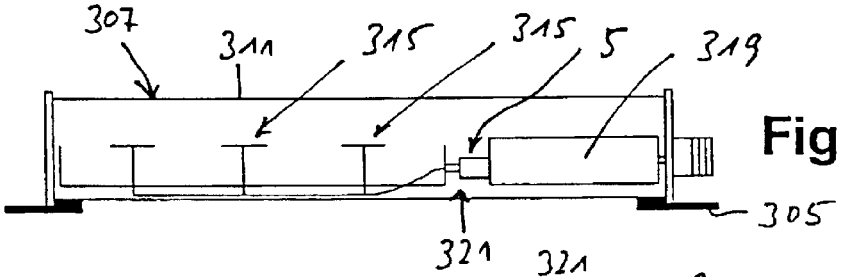
FIG. 2 shows a schematic cross-sectional illustration along the line II—II with the electrical component in the connected state.

FIGS. 4 and 5 show exemplary embodiments in which the two connecting sections 7 and 9, in which the inner conductor and outer conductor are coupled without any contact whatsoever, that is to say without using a permanently inserted insulator or dielectric. When using a corresponding connector in an air atmosphere, the dielectric shown in FIGS. 1 and 2 consists only of air.

Figure 6:
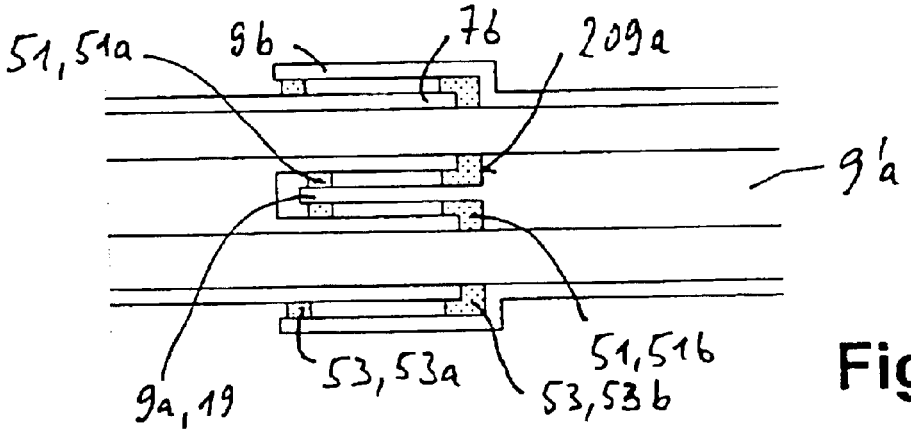
FIG. 6 shows an exemplary embodiment modified from that shown in FIG. 4, using dielectric spacers.

The exemplary embodiment shown in FIG. 6 illustrates a modification to the extent that, in this case, partial fixings with nonconductive material 51 and 53, respectively, have been used for relative fixing of the two connecting sections 7 and 9. This nonconductive material 51 and 53 is used for different shapes at different points. In the exemplary embodiment shown in FIG. 6, this nonconductive material is used, for example, in the form of a spacer or ring 51*a* for fixing the inner conductor 9*a* with respect to the inner conductor 7*a*, to be precise in this case in the area of the free end of the inner conductor 9*a*. A second insulating material 51*b* is used essentially as a spacer to limit the insertion depth of the connecting parts 7 and 9, and for this purpose, in the exemplary embodiment shown in FIG. 6, is arranged in the area in which the end of the connecting part 7*a* is formed adjacent to the step 209*a* on the inner conductor 9*a*, at which point the actual inner conductor section 9*a* merges into an inner conductor cable section 9'*a* with a larger material cross section.

In a corresponding way, the spacers 53*a* and 53*b* are provided in the form of a nonconductive dielectric 53, in order to avoid any conductive contact between the outer conductor sections 7*b* and 9*b*. One section 53*a* with insulating material 53 is in this case once again provided at the free end of one outer conductor section 9*b*, and the other insulating material 53 is provided at the end of the inserted, other outer conductor section 7*b*. This material 53*b* is also configured such that in consequence it limits the insertion depth of the two connecting sections 7 and 9 relative to one another.

Figure 7:
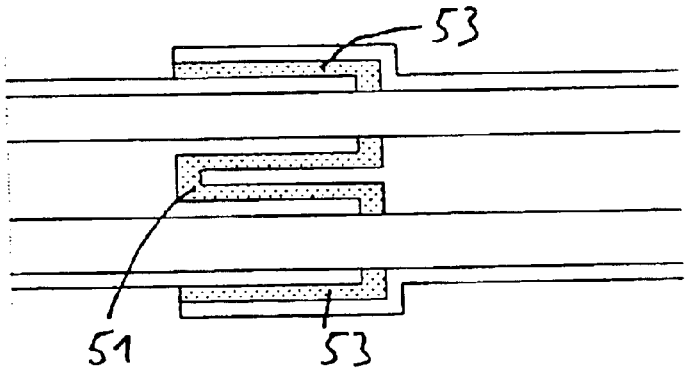
FIG. 7 shows an exemplary embodiment, once again modified, with modified spacers between the inner and outer conductors of the connectors that are used.

In contrast, FIG. 7 shows that the corresponding spacer elements 51*a* and 51*b*, which are separated in FIG. 6, can also be in the form of integral, continuous material 51, for relative alignment of the two inner conductors. A corresponding situation applies to the spacer 53 for the two outer conductor sections. In this case as well, only a single spacer material has been used, which connects the spacer elements 53*a* and 53*b*, which are used individually in FIG. 3, as an integral part.

Figure 3:
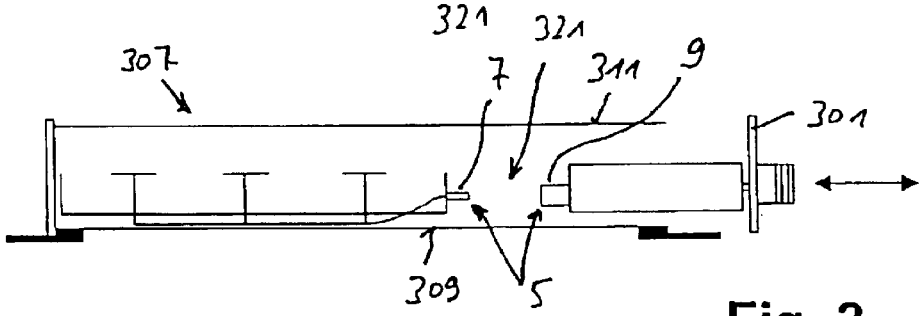
FIG. 3 shows an illustration corresponding to that in FIG. 2, while the electrical physical component is connected.

However, provision is preferably made for the coupling, which is preferably coaxial and in which there is no contact, to, for example, two connectors which are arranged parallel alongside one another to be provided for a component 319 that is to be connected in such a way that a bottom cover in the antenna, for example a cover 301*a* in FIG. 1, is opened in order subsequently just to push in the corresponding component 319 to be connected, or to pull out a component which has already been inserted and connected and to replace it by another, once any possible mechanical attachment parts have been opened. In some circumstances, this lower housing cover 301 can also be firmly connected to the component 319 which is to be installed, as is indicated in FIG. 3.

As can also be seen from the exemplary embodiment, the component 319 (which in some circumstances is in the form of an amplifier), for example, can be replaced relatively easily, since there is no need to unscrew any RF connection between the antenna and the amplifier. This reduces the maintenance and assembly costs. Intermodulation problems are avoided by the connection without any contact. Furthermore, in the illustrated exemplary embodiment, the amplifier is integrated in the antenna housing, so that only the normal antenna on the housing cover 307 can be seen from the outside.

A further advantage of the explained connection without any contact is also that it at the same time provides direct-current decoupling. Furthermore, in the case of multiband antennas, all the components which are required for the individual frequency bands, for example all the amplifiers, can be decoupled by means of a single insert. Particularly in the case of what are referred to as intelligent antennas (smart antennas), other RF control modules and control units can also be connected, in addition to the explained components, for example in the form of amplifiers.

Figure 8:
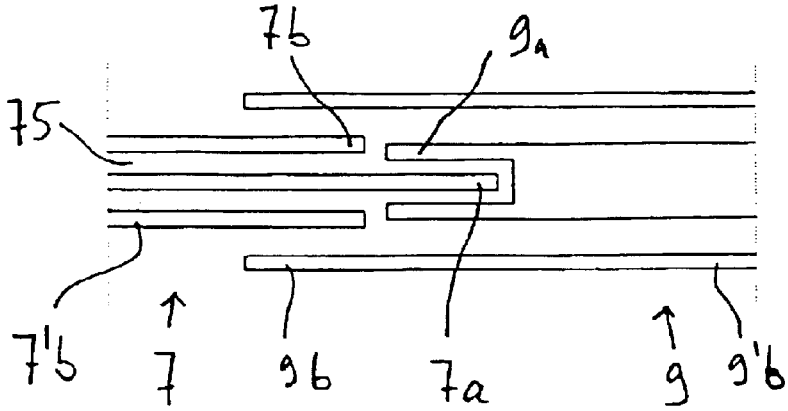
FIGS. 8 to 10 show further exemplary embodiments, which are modified from the exemplary embodiment mentioned above, for coaxial connections without any contact and with different diameters, which can be used for the mobile radio antenna.
Figure 9:
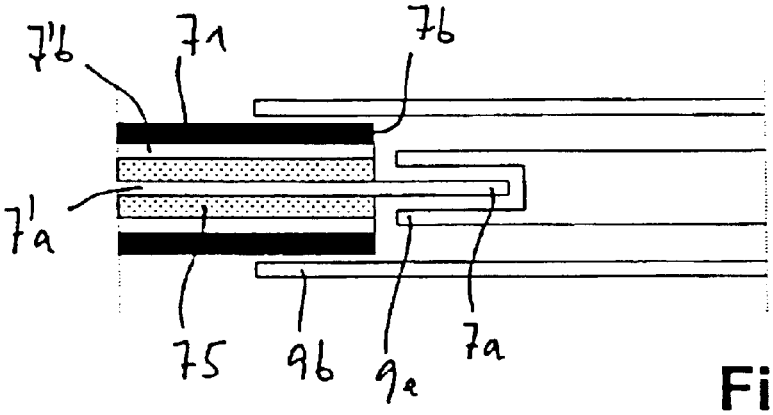
Figure 10:
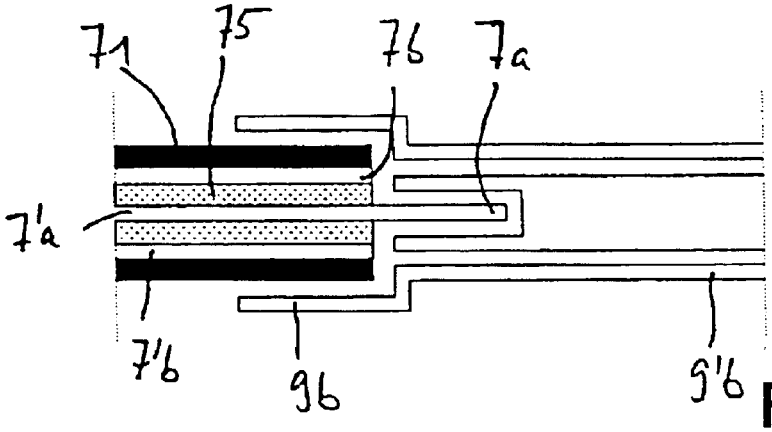

The following text provides just a brief description of the exemplary embodiments based on the schematic axial section view shown in FIGS. 8, 9 and 10, which illustrate modifications from the previous exemplary embodiments.

The exemplary embodiments shown in FIGS. 8 to 10 differ from the exemplary embodiments shown in FIGS. 1 to 6 essentially in that cable sections which have a different diameter have been used for the coaxial connections without any contact. However, corresponding inner conductor and/or outer conductor sections 7*a*, 9*a*, 7*b*, 9*b* with different diameters can also be coupled provided that both connectors have the same characteristic impedance Z1=Z2, or essentially have the same characteristic impedance, that is to say the characteristic impedances do not differ from one another by more than 20%, and preferably by not more than 10% or 5%. In the exemplary embodiment illustrated in FIG. 8, air (or some other gaseous dielectric) may in this case be used, as already explained, as the dielectric, with air being the only sensible option under normal circumstances when used in atmospheric conditions.

By way of example, the exemplary embodiment shown in FIGS. 9 and 10 shows the first connecting section 7 having a cable sheath 71 from the outside to the inside, for example composed of a suitable plastic such as PVC, FEP etc. The outer conductor 7'*b* together with the corresponding outer conductor section 7*b* is then located underneath the insulating cable sheath 71. The inner conductor 7'*a*, which is in the form of a pin in the illustrated exemplary embodiment, is arranged located coaxially in the center with respect to the associated inner conductor section 7*a* which, with the outer conductor and the outer conductor section 7'*b*, 7*b*, is separated by a dielectric 75 which may be composed of appropriately suitable insulating materials, for example likewise plastic etc., but which may just as well be formed by air.

As can be seen from all of the FIGS. 8 to 10, both the diameter of the two outer conductors and the diameter of the inner conductors of the two connecting parts 7 and 9 are different, with the diameter ratio of the two cables being the same, that is to say the ratio of the inner conductor to the outer conductor with respect to the two connecting parts 7 and 9 is in each case the same, or is at least in approximately a similar order of magnitude, so that differences from this are less than 20%, and preferably less than 10%. This makes it possible to ensure that the two connecting parts 7 and 9 of the connector have the same characteristic impedance, that is to say Z1=Z2. Thus, for example, it is also possible to insert a coaxial cable directly into the connector, that is to say the coaxial cable would form the connecting section 7, which is located on the left in FIG. 9 or 10 and which can just be inserted into the further connecting sections 9. In this situation, the inner conductor should project with the effective electrical length $L=\lambda/4$, that is to say it should project with the appropriate length axially beyond the associated outer conductor section. The difference should be less than 20%, and preferably less than 10%. The best value is achieved when $\lambda$ corresponds to the mid-wavelength of the frequency band to be transmitted. The outer conductor can then be coupled with or without a sudden change in diameter, as is illustrated merely by way of example in the various figures.

It should also be noted that, in FIGS. 4 to 7, the inner conductor 7 *a*, which is shown on the left and is associated with the connecting section 7, and the inner conductor section 7*a* has been shown in the form of a female connector, and that the inner conductor section 9*a*, which is located on the right in the figures and is associated with the connecting part 9, has always been shown in the form of a pin. However, the pin and female connector can also be reversed, as can also be seen, inter alia, from FIGS. 7 to 9, in which the inner conductor 7*a* is now in the form of a pin and the inner conductor 9*a* is in the form of a female connector. In principle, this also applies to the outer conductors 7*b* and 9*b*, which can be formed with the opposite configuration geometry to the exemplary embodiments shown in FIGS. 4 to 7, that is to say, in contrast to the illustrations in the drawings, with the outer conductor sections 7*b* and 9*b* effectively being interchanged.

What is claimed is:

1. Antenna, in particular a mobile radio antenna for a base station, comprising:

at least one electrical or electronic component is positioned in the antenna housing or immediately adjacent to the antenna housing and connected for RF purposes to the antenna elements which are associated with the antenna, the electrical connection between the component and the antenna elements being made via an interface, such that at least two inner conductor sections and/or two outer conductor sections are coupled or can be coupled without any contact, an antenna-side connecting section and a connecting section, which interacts with it and is part of the component which can be connected, and wherein the components which can be connected to the antenna for RF purposes can be connected by pushing in or pushing out the at least one associated connecting section into or out of the correspondingly designed antenna-side connecting section.

2. Antenna according to claim 1, characterized in that wherein both the inner conductor sections and the outer conductor sections of the at least two connecting sections of a connector are formed coaxially.

3. Antenna according to claim 1, wherein the two connecting sections are provided with one or more spacers in the area of their outer conductor coupling surfaces and/or their inner conductor coupling surfaces, via which the inner conductor sections and/or the outer conductor sections are held spaced apart.

4. Antenna according to one of claims 1, characterized in that wherein two or more preferably coaxial connecting sections without any contact are combined to form a common multiconnector section.

5. Antenna according to one of claims 1, wherein at least one of the two connecting sections of the connector, or both connecting sections, has or have an O-ring, preferably composed of silicone, which is provided in the area of the outer conductor coupling.

6. Antenna according to one of claims 1, wherein the maximum axial insertion depth of the two connecting sections is limited by using an insulating spacer.

7. Antenna according to one of claims 1, wherein at least one connecting section is directly firmly connected to an RF component which is associated with it.

8. Antenna according to claim 7, wherein both connecting sections of a connection are directly and firmly connected to the RF component which is respectively associated with them, that is to say they are connected both electrically and mechanically.

9. Antenna according to one of claims 1, wherein at least one connecting section and preferably both connecting sections is or are connected or can be connected via a coaxial cable to an RF component which is associated with it or them.

10. RF connector according to one of claims 1, wherein the size of the diameter of the inner conductors which are provided axially adjacent to the inner conductor coupling surfaces of the connecting sections which are to be connected without any contact is at least approximately, and preferably, the same.

11. RF connector according to one of claims 1, wherein the internal diameter of the outer conductors which are provided axially adjacent to the outer conductor coupling surfaces of the connecting sections which are to be connected without any contact is at least approximately, and preferably, the same.

12. RF connector according to one of claims 1, wherein the external diameter of the outer conductors axially adjacent to the outer conductor coupling surfaces is at least approximately, and preferably, the same.

13. RF connector according to one of claims, characterized in that wherein the connection without any contact has different diameters for the inner and outer conductors.

14. RF connector according to one of claims 1, wherein the connection without any contact with respect to the first connecting section and the second connecting section has the same characteristic impedance ± less than 20%, preferably ± less than 10%, in particular approximately the same characteristic impedance.

15. RF connector according to one of claims 1, wherein at least one connecting section has a coaxial cable which on the outside has an insulating cable sheath, and in that the outer conductor of the other connecting section clasps the cable sheath with the outer conductor, which is located underneath it, of the first connecting section when the are inserted in one another.

16. Antenna, in particular a mobile radio antenna for a base station, comprising:

at least one electrical or electronic component is positioned in the antenna housing or immediately adjacent to the antenna housing and is connected for RF purposes to the antenna elements which are associated with the antenna, the electrical connection between the component and the antenna elements being made via an interface, such that at least two inner conductor sections and/or two outer conductor sections are coupled or can be coupled without any contact, an antenna-side connecting section and a connecting section, which interacts with it and is part of the component which can be connected, the two connecting sections can be positioned with respect to one another via a holding device in an axial and/or radial relative position which can be predetermined, and wherein the inner conductor and outer conductor sections which are respectively provided with the inner conductor coupling surfaces and with the outer conductor coupling surfaces are arranged in their functional position, without touching and without any insulating materials and/or any solid dielectric located between them.

17. Antenna according to one of claims 1, wherein the component which is to be connected can preferably be connected and disconnected by pushing it in and out, respectively, after opening a closing cap or a closing cover, or a bottom boundary or some other housing boundary on the relevant interface to the antenna elements in the antenna housing.

18. Antenna according to one of claims 1, wherein the two connecting sections can be rotated relative to one another about their concentric coaxial longitudinal axis, and/or in that the two connecting sections can be connected axially to one another in a different relative rotation position about their concentric coaxial longitudinal axis, and/or in that the two connecting sections are designed to be rotationally symmetrical, or essentially rotationally symmetrical, about their axial axis.

19. Antenna according to one of claims 1, wherein the inner conductor coupling without any contact is in the form of a pot.

20. Antenna according to one of claims 1, wherein the outer conductor coupling without any contact is in the form of a pot.

21. Antenna according to one of claims 1, wherein the axial length of the inner conductor sections which are coupled without any contact corresponds to $\lambda/4$, preferably $\lambda/4\pm$less than 20%, preferably $\lambda/4\pm$less than 10%, and in particular of approximately or at least approximately $\lambda/4$ with respect to the frequency band to be transmitted, preferably with respect to the mid-frequency to be transmitted.

22. Antenna according to one of claims 1, wherein the axial length of the outer conductor sections which are coupled without any contact corresponds to $\lambda/4$, preferably $\lambda/4\pm$less than 20%, preferably $\lambda/4\pm$less than 10%, and in particular of approximately or at least approximately $\lambda/4$ with respect to the frequency band to be transmitted, preferably with respect to the mid-frequency to be transmitted.

23. Antenna according to one of claims 1, wherein one inner conductor section is formed like a pot, forming an inner conductor recess which extends axially from its end face, into which inner conductor recess that inner conductor section which is electrically connected to the other connecting section can be inserted without touching it.

24. Antenna according to one of claims 1, wherein the outer conductor section which is located in the coupling area, of one outer conductor is widened in the form of a pot with a larger internal diameter, to be precise holding the outer conductor section of the other connecting section which interacts with it.

25. Antenna according to claim 24, wherein the outer conductor section of one connecting section ends in the area of the outer conductor coupling surfaces without changing its external and/or internal diameter.

26. Antenna according to claim 24, wherein the internal and/or external diameter of the outer conductor section corresponds to the internal and/or external diameter of the other outer conductor section.

* * * * *